US005310495A

United States Patent [19]

Hill et al.

[11] Patent Number: 5,310,495

[45] Date of Patent: May 10, 1994

[54] TRANSPARENT SOAP BAR

[75] Inventors: Michael I. Hill, Fords; Jerry J. Krupa, Rockaway Township, Morris County, both of N.J.

[73] Assignee: Lever Brothers Company, Division of Conopco, Inc., New York, N.Y.

[21] Appl. No.: 541,453

[22] Filed: Jun. 21, 1990

Related U.S. Application Data

[63] Continuation of Ser. No. 926,602, Nov. 4, 1986, abandoned.

[51] Int. Cl.[5] ..... C11D 9/32; C11D 9/30

[52] U.S. Cl. ..... 252/118; 252/105; 252/117; 252/DIG. 16

[58] Field of Search ..... 252/108, 110, 111, 117, 252/118, 122, 133, 134, 174, DIG. 6

[56] References Cited

U.S. PATENT DOCUMENTS

| | | | |
|---|---|---|---|
| 2,820,768 | 1/1958 | Fromont | 252/118 |
| 3,562,167 | 2/1971 | Kamen et al. | 252/121 |
| 3,793,214 | 2/1974 | O'Neill | 252/117 |
| 3,926,828 | 12/1975 | O'Neill et al. | 252/117 |
| 3,969,259 | 7/1976 | Lages | 252/107 |
| 4,206,069 | 6/1980 | Borello | 252/122 |
| 4,290,904 | 9/1981 | Poper et al. | 252/117 |
| 4,397,760 | 8/1983 | Story et al. | 252/370 |
| 4,468,338 | 8/1984 | Lindberg | 252/105 |
| 4,474,683 | 10/1984 | Story et al. | 252/369 |
| 4,493,786 | 1/1985 | Joshi | 252/134 |
| 4,504,433 | 3/1985 | Inui et al. | 264/232 |
| 4,517,107 | 5/1985 | Clarke et al. | 252/108 |

FOREIGN PATENT DOCUMENTS 61-155499 7/1986 Japan .

*Primary Examiner*—Prince Willis, Jr.
*Attorney, Agent, or Firm*—Milton L. Honig

[57] ABSTRACT

A transparent bar is disclosed which requires the components to fit within three critical ratios. The composition comprises a mixture of alkanolammonium and alkali metal $C_{12}$—$C_{22}$ atom fatty acid salts, the mole ratio of alkanolammonium to alkali metal fatty acid salt being from about 0.1 to less than 1.0. A liquid solvent system must also be present which includes an amount of water and free alkanolamine in a weight ratio ranging from greater than 0.25 to less than 1.0. The weight ratio of total fatty acid salts to solvent must range from greater than 0.02 to less than 1.0.

14 Claims, No Drawings

TRANSPARENT SOAP BAR

This is a continuation of Ser. No. 926,602, filed Nov. 4, 1986, now abandoned.

BACKGROUND OF THE INVENTION

1. Field of the Invention

The invention relates to a transparent soap bar of exceptional clarity.

2. The Prior Art

Toilet soap is a mixture of long chain fatty acid salts and solvent, normally water, which together form three phases: solid crystal, liquid crystal and solution. Opacity as found with most soap bars results from the scattering of light at the interfaces between the several phase domains. In particular, the presence of many small solid crystals within the amorphous continuum of a toilet bar causes incident light to pass through many interfaces. Since the several phases have different refractive indices, light will be scattered rather than pass through the bar. It should be noted that the solid crystals are by nature anisotropic. They have a refractive index that is dependent upon orientation. Consequently, the refractive index of the liquid phases cannot be simultaneously matched to the refractive indices of all orientations of the solid crystals.

One approach to improve the transparency of toilet soap is to reduce the size of the solid crystals. Reduction minimizes or even eliminates light scattering due to these crystals. For instance, U.S. Pat. No. 4,517,107 (Clarke et al.) reports a soap-containing formulation becoming transparent through shear working between two mutually displaceable surfaces in an apparatus known as a cavity transfer mixer.

Solid crystals have also been avoided by crystallizing the soap mixture from a solution containing an evaporatable solvent such as ethanol. The procedure results in limiting the size of any solid crystals that might form. Illustrative in U.S. Pat. No. 4,504,433 (Inui et al.) wherein tallow/palm oil was saponified with aqueous sodium hydroxide in the presence of 20% ethanol. To the combination was added white sugar, polyethylene glycol and glycerine which resultant composition was poured into casts for cooling and drying. The presence of sugar served to match the refractive indices of the several phases and to produce a transparent bar.

Another approach is that described by U.S. Pat. No. 3,926,828 (O'Neill et al.) which indicates that saturated free fatty acids of branched chain structure provide the key to obtaining soap bars that retain transparency and initial glossy appearance after repeated usage. The O'Neill composition is typical of bars containing free triethanolamine.

U.S. Pat. No. 2,820,768 (Fromont) is the classic transparent soap bar disclosure first coining the term "neutrogenous" indicating the presence of a substantial quantity acid neutralizing material, i.e., triethanolamine. The resultant bars contain a mixture of 35–40% each of sodium and triethanolamonium soaps including substantial amounts of free triethanolamine. Starting fats and oils are reported to preferably contain 30% castor oil for improving transparency and ricinoleates, derived from saponified castor oil, as aids for dissolving higher fatty acid salts. The ricinoleates are said to inhibit crystallization of the higher fatty acid salts inside the final soap on cooling. It should be noted that ricinoleates and castor oil are expensive components desirably absent from soap products for cost reasons.

U.S. Pat. No. 4,206,069 (Borrello) note the cost problems and further indicates stickiness difficulties with prior art transparent bars. Under high humidity, it was recognized that known transparent bars are substantially hygroscopic whereupon transparency becomes lost. The patent suggests incorporating 10 to 65% of certain synthetic detergent components to harden the bar, reduce cost and improve transparency. Mixtures of sodium and triethanolammonium soaps are combined with the synthetic detergent. Included therein must be 10 to 45% of a non-volatile solvent such as an alkylene glycol or triethanolamine.

An approach combining the "neutrogenous" idea with physical shearing is found in U.S. Pat. No. 4,474,683 and U.S. Pat. No. 4,397,760, both to Story et al. Therein, a fatty acid mixture including glycerine and triethanolamine is combined with a caustic soda mixture in an intensive countercurrent mixing process providing vigorous shear. The resultant soap was said to be slightly filmy but became virtually crystal clear when wet. The bar was said to contain a mixture of sodium and triethanolamine (TEA) soaps in an amount of 30.5 and 25.9%, respectively; there was also stated to be 22.1% free TEA and 6.3% water present.

Many of the prior art bars, especially those produced by the "neutrogenous" triethanolamine type processes, have substantial color problems. Although transparent, most of the known materials survive processing in the form of a dark brown color. U.S. Pat. No. 4,468,338 (Lindberg) notes such difficulty with respect to mixed sodium and triethanolammonium fatty acid soaps. Additives such as combinations of citrate and alkali metal metabisulfite must be incorporated therein to control darkening and loss of transparency.

It is, therefore, an object of the present invention to provide a transparent soap bar of substantially improved clarify, such clarity being maintained during use of the bar.

It is another object of the present invention to provide a soap bar not requiring expensive fats and oils such as castor oil and ricinoleates to obtain adequate clarity.

It is a further object of the present invention to provide a transparent soap bar substantially less colored than that described by the prior art.

Finally, it is an object of the present invention to provide a transparent soap bar of improved hardness which avoids the stickiness associated with previously known bars.

Other objects and advantages will be discussed in the further description of the present invention.

SUMMARY OF THE INVENTION

A transparent bar is provided comprising:

(i) a mixture of alkanolammonium and alkali metal $C_{12}$–$C_{22}$ atom fatty acid salts, the mole ratio of alkanolammonium to alkali metal fatty acid salt ranging from about 0.1 to less than 1.0;

(ii) a liquid solvent system including an amount of water and free alkanolamine in a weight ratio ranging from greater than 0.25 to less than 1.0; and wherein the weight ratio of total fatty acid salt to solvent ranges from greater than 0.02 to less than 1.0.

DETAILED DESCRIPTION OF THE INVENTION

The present invention is a composition for a transparent bar that predominantly, and preferably exclusively, contains one isotropic phase. The bar comprises a mixture of alkanolammonium and alkali metal soaps in a solvent primarily comprising free alkanolamine and water. These components have, as noted above, been known as elements of transparent soap bars. It has, however, now been found that there are three critical ratios lying within a narrow range of values which permits substantial improvement of product clarity and color. Additionally, the bars of this invention do not require nor desirably contain special branched chain fatty acids, castor oil, ricinoleates, or other additives to achieve a transparent bar. The critical ratios found by this invention are as follows:

(1) The weight ratio of total fatty acid salt to solvent must range from greater than 0.02 to less than 1.0, preferably between 0.25 and 0.75, optimally between 0.5 and 0.6. The ratio must be sufficiently low to prevent formation of solid crystals. However, the ratio must also be high enough to permit formation of a rigid bar at ambient temperature.

(2) The weight ratio of water to free alkanolamine should be from greater than 0.25 to less than 1.0, preferably from 0.35 to 0.6, optimally from 0.4 to 0.5. These values reflect sufficient amounts of these components to have the solvent dielectric constant high enough to prevent the soaps from becoming insoluble in the solvent system. Growth of solid crystals is thereby avoided. However, the ratio of water to alkanolamine must also be low enough so that the solvent dielectric constant is sufficiently low to prevent the large alkanolammonium counter-ion from dissociating. This counterion greatly increases the head size of the soap molecules. As a result, isotropic cubic liquid crystals form consisting of packed sphere-like micelles, rather than the anisotropic lamellar or hexagonal liquid crystal phases.

For purposes of this invention, "free" alkanolamine refers to any molar excess alkanolamine beyond that which is required for neutralization of any acid present in the bar composition. Alkanolamine and alkanolammonium terms used throughout this disclosure are intended to include $C_1$–$C_3$ mono-, di- and trialkanolamine and ammonium species. For example, mono-, di-and/or tri-ethanolamine and ammonium ions are suitable for the present invention. Particularly preferred, however, is triethanolamine and triethanolammonium cation.

(3) The mole ratio of alkanolammonium to alkali metal soap should range from about 0.1 to less than 1.0, preferably between 0.5 and 0.9, optimally between 0.6 and 0.7. This range insures that cubic liquid crystal forms. With a ratio that is too low, the small head size of the soap anions will permit anisotropic liquid crystals to form. However, if the ratio is too large, steric hinderance will impede micellar formation. This reduces soap solubility and gives rise to solid crystals.

The optimum values for the three ratios are interdependent. For example, it is possible to compensate for a higher ratio of soap to solvent by increasing the ratio of water to alkanolamine, provided that this does not raise the dielectric constant of the solvent to the point where there is sufficient dissociation of the trialkanolammonium counterion. If this occurs, an anisotropic liquid crystal phase would arise.

Additionally, the desired values for these ratios will depend upon the particular chain length distribution and degree of unsaturation of the soaps present. For example, decreasing the average chain length or increasing the degree of unsaturation will increase the solubility of the soaps. A higher ratio of soap to solvent is thereby permitted. However, this also increases the tendency of the alkanolammonium counterion to dissociate, which then requires a lower ratio of water to alkanolamine in the solvent. Adjusting the ratios in accord with the ranges outlined above permits a composition containing virtually no unsaturated soaps. It has been suggested that unsaturated soaps give transparent bars having a characteristic yellow color.

Minor amounts of organic materials such as saccharides or antioxidants may be added to the solvent system without the loss of transparency, provided that the dielectric constant of the solvent mixture is not radically changed. These additives should not cause crystallization of solid soap crystals or dissociation of the alkanolammonium cation. Moreover, the concentration of any such materials should not reduce the level of free alkanolamine to below 10% of the total composition.

Care should also be taken to avoid the addition of electrolytes to the solvent system. Electrolytes serve both to reduce solubility of the soaps and increase the tendency to form anisotropic liquid crystals.

Each of the foregoing ratios have been explained in terms of physical phenomena. It is to be noted, however, that these are merely theories and the discoveries of the present invention are not so bound.

A liquid solvent system is an essential component of the present invention. For purposes of definition, the solvent system must comprise components liquid at room temperature. Water and free alkanolamine will always be components of the solvent. However, additional water-miscible organic liquid materials when incorporated in the formulation must also be considered in calculating the amount of solvent present. Thus, under the heading of solvent must be considered monohydric and polyhydric alcohols such as ethanol, alkylene glycols, glycerine and the like; alkyl and aryl ethers such as diethyl ether, phenylethyl ether and the like; alkyl and aryl esters such as diethyl phthalate, ethyl acetate, isopropyl palmitate, diethyl succinate, and the like; alkyl and aryl ketones such as methylethyl ketone, acetone and the like; and mixtures thereof.

The composition described herein is prepared by heating and mixing the components until they dissolve. Thereafter, the composition is allowed to cool and solidify. The mixture should be quiescent during this solidification. Nevertheless, the mixture may be poured into individual molds before cooling and solidification, if desired. It may be particularly desirable for these molds to be transparent.

High shear processing is neither necessary for the solidified material to become transparent nor desirable once solidification has begun as it causes a loss of rigidity in the material. It should also be appreciated that this composition does not require drying or maturation time to achieve optimal clarity.

The term "transparent" as used in this specification is intended to connote its usual dictionary definition. Thus, a transparent soap, like glass, allows ready viewing of objects behind it. By contrast, a translucent soap although allowing light to pass through, causes the light to be so scattered, as by a very small proportion of crystals or insolubles, that it will be impossible to clearly identify objects behind the translucent soap.

Within the context of this invention, a soap bar is deemed to be transparent if the maximum transmittance of light of any wavelength in the range of 200 to 800 nm through a sample 10 cm thick is at least 1%. A bar is deemed translucent if the maximum transmittance of such light through the sample is between 0.01% and 1%. Finally, a bar is deemed opaque if the maximum transmittance of such light is below 0.01%. This transmittance can be easily measured by placing a solid soap sample of the required thickness in the light beam path of a UV-VIS Spectrophotometer such as the Hewlett-Packard 8451A Diode Array Spectrophotometer. The advantage of this method of assessing transparency over previously published methods is that it is highly sensitive to optical clarity while independent of color.

The term "soap" is used herein in its popular sense, i.e., the alkali metal or alkanolammonium salt of aliphatic alkane-or alkene monocarboxylic acids. The term alkanolammonium refers to one, two or three $C_1$–$C_4$ hydroxyalkyl groups substituted onto a nitrogen cation, triethanolammonium cation being the species of choice. Suitable alkali metal cations are those of potassium and sodium, the latter being much preferred.

Soaps useful herein are the well known salts of natural or synthetic aliphatic (alkanoic or alkenoic) acids having about 12 to 22 carbon atoms, preferably about 12 to 18 carbon atoms. Soaps having the fatty acid distribution of coconut oil may provide the lower end of the broad molecular weight range. Those soaps having the fatty acid distribution of peanut or rapeseed oil, or their hydrogenated derivatives, may provide the upper end of the broad molecular weight range.

It is preferred to use soaps having the fatty acid distribution of coconut oil or tallow, or mixtures thereof, since these are among the more readily available fats. The proportion of fatty acids having at least 12 carbon atoms in coconut oil soap is about 85%. This proportion will be greater when mixtures of coconut oil and fats such as tallow, palm oil, or non-tropical nut oils or fats are used, wherein the principle chain lengths are $C_{16}$ and higher.

Coconut oil employed for the soap may be substituted in whole or in part by other "high-lauric" oils, that is, oils or fats wherein at least 50% of the total fatty acids are composed of lauric or myristic acids and mixtures thereof. These oils are generally exemplified by the tropical nut oils of the coconut oil class. For instance, they include: palm kernel oil, babassu oil, ouricuri oil, tucum oil, cohune nut oil, murumuru oil, jaboty kernel oil, khakan kernel oil, dika nut oil, and ucuhuba butter.

A preferred alkali metal soap is a mixture of about 15% to about 20% coconut oil and about 80% to about 85% tallow. These mixtures contain about 95% fatty acids having about 12 to about 18 carbon atoms. The soap may be prepared from coconut oil, in which case the fatty acid content is about 85% of $C_{12}$–$C_{18}$ chain length.

The soaps may contain unsaturation in accordance with commercially acceptable standards. Excessive unsaturation is normally avoided.

Small amounts of sulfite salts may also be desirably present. These salts may be selected from the group consisting of bisulfite, hydrosulfite, metabisulfite, sulfite and mixtures thereof. Suitable salt counter-ions include alkali metal, alkaline earth metal, ammonium, alkyl or hydroxyalkyl ammonium cations and mixtures thereof. When present, the salts can constitute from about 0.03 to less than 3.0 wt. %, preferably from 0.03 to less than 0.2%, optimally from 0.03 to 0.06%. The transparent toilet bars of this invention, as previously stated, have the potential for exceptionally low color provided suitable color reducing agents are present. In known transparent bars, color reducing agents are not as effective as with the present compositions.

Adjunct materials including germicides, perfumes, and colorants may also be present. For cost and performance reasons it is, however, undesirable to include castor oil, ricinoleates, branched chain saturated fatty acids and amounts of soap greater than 50% of the total bar.

The following examples will more fully illustrate the embodiments of this invention. All parts, percentages and proportions referred to herein and in the appended claims are by weight of the total composition unless otherwise stated.

EXAMPLE 1

Illustrative of the transparent compositions of the present invention are those listed in Tables I-A through I-E. These formulations were all prepared in the same manner as here outlined. Fatty acid, sodium metabisulfite, sodium borohydride and butyl hydroxyanisole (where present) and a small portion of the water were dissolved in triethanolamine. The mixture was then heated to approximately 80° C. for 10 minutes. Solvents, including the balance of the water, propylene glycol, Polyol A-625, and ethanol (where present), glycerine, and the sodium soap were then added. A condenser was used to avoid loss of volatiles. Subsequent to combining the components, the mixture was stirred at 80° C. until all components were dissolved. Perfume, if present, was added last. This mixture was then poured into molds and allowed to cool. The resulting soap bars were firm and clear.

TABLE I-A

COMPOSITIONS VARYING IN WEIGHT RATIO OF TOTAL SOAP TO SOLVENT

| Experiment | TEA | E-132 Fatty Acid | E-625 Fatty Acid | Glycerine | Propylene Glycol | Added Water | Soap | T | Moist. | NaHSO3 | NaBH4 | Perfume |
|---|---|---|---|---|---|---|---|---|---|---|---|---|
| 1 | 62.6 | 0.6 | — | 8.3 | — | 27.3 | 1.1 | 1 | 12.0 | 0.05 | .0017 | — |
| 2 | 58.2 | 1.7 | — | 12.2 | — | 24.8 | 3.0 | 1 | 12.0 | 0.06 | .0019 | — |
| 3 | 56.2 | 3.2 | — | 11.6 | — | 23.2 | 5.7 | 1 | 12.0 | 0.05 | .0018 | — |
| 4 | 51.1 | 7.0 | — | 10.1 | — | 19.3 | 12.4 | 1 | 12.0 | 0.05 | .0016 | — |
| 5 | 48.8 | 9.2 | — | 8.3 | — | 17.3 | 16.3 | 1 | 12.0 | 0.05 | .0017 | — |
| 6 | 45.4 | 5.8 | 4.3 | — | 8.4 | 14.9 | 20.7 | 1 | 12.0 | 0.04 | .0013 | 0.4 |
| 7 | 45.0 | 11.6 | — | 8.3 | — | 14.7 | 20.4 | 1 | 11.8 | 0.04 | .0013 | — |
| 8 | 46.5 | 11.9 | — | 4.3 | — | 15.3 | 21.1 | 1 | 11.8 | 0.04 | .0013 | 0.9 |
| 9 | 49.6 | 6.4 | 4.7 | — | — | 16.3 | 22.6 | 1 | 12.0 | 0.04 | .0014 | 0.4 |
| 10 | 48.6 | 12.5 | — | — | — | 16.0 | 22.0 | 1 | 11.8 | 0.04 | .0014 | 0.9 |

TABLE I-A-continued

COMPOSITIONS VARYING IN WEIGHT RATIO OF TOTAL SOAP TO SOLVENT

| Experiment | TEA | E-132 Fatty Acid | E-625 Fatty Acid | Glycerine | Propylene Glycol | Added Water | Soap | T | Moist. | NaHSO3 | NaBH4 | Perfume |
|---|---|---|---|---|---|---|---|---|---|---|---|---|
| 11 | 41.5 | 14.1 | — | 7.3 | — | 14.0 | 23.1 | 1 | 4.6 | 0.03 | .0011 | — |
| 12 | 40.0 | 15.2 | — | 6.9 | — | 13.0 | 24.9 | 1 | 4.6 | 0.03 | .0011 | — |
| 13 | 38.7 | 16.2 | — | 6.5 | — | 12.1 | 26.4 | 1 | 4.6 | 0.03 | .0010 | — |

TABLE I-B

COMPOSITIONS VARYING IN WEIGHT RATIO OF WATER TO FREE TEA

| Experiment | TEA | E-132 Fatty Acid | E-625 Fatty Acid | Glycerine | Polyol | Propylene Glycol | Added Water | Soap | T | Moist. | NaHSO3 | NaBH4 | Perfume | BHA |
|---|---|---|---|---|---|---|---|---|---|---|---|---|---|---|
| 14 | 44.8 | 11.5 | — | 8.3 | — | 14.7 | 0 | 20.2 | 1 | 12.0 | 0.20 | — | — | 0.2 |
| 15 | 44.7 | 11.5 | — | 8.3 | — | 7.4 | 7.4 | 20.2 | 1 | 12.0 | 0.20 | — | — | 0.2 |
| 16 | 44.7 | 11.5 | — | 8.3 | 5.0 | — | 9.8 | 20.2 | 1 | 11.8 | 0.20 | — | — | 0.2 |
| 17 | 44.6 | 11.4 | — | 8.3 | — | — | 14.6 | 20.2 | 1 | 11.8 | 0.04 | .0013 | 0.8 | — |
| 18 | 44.6 | 11.4 | — | — | — | 8.3 | 14.6 | 20.2 | 1 | 11.8 | 0.04 | .0013 | 0.8 | — |
| 19 | 45.3 | 8.7 | 2.1 | 8.4 | — | — | 14.8 | 20.6 | 1 | 12.0 | 0.04 | .0013 | — | — |
| 20 | 42.8 | 11.0 | — | 8.0 | — | — | 19.5 | 17.9 | 1 | 4.6 | 0.04 | .0012 | 0.8 | — |
| 21 | 44.6 | 11.4 | — | 4.2 | — | — | 18.7 | 20.2 | 1 | 11.8 | 0.04 | .0013 | 0.8 | — |
| 22 | 44.6 | 11.4 | — | — | — | — | 24.4 | 18.7 | 1 | 4.6 | 0.04 | .0013 | 0.8 | — |
| 23 | 36.9 | 11.4 | — | 8.3 | — | — | 23.9 | 18.7 | 1 | 4.6 | 0.04 | .0013 | 0.8 | — |
| 24 | 34.3 | 11.4 | — | 8.3 | — | — | 25.6 | 20.3 | 1 | 12.0 | 0.05 | .0017 | — | — |
| 25 | 29.1 | 11.4 | — | 8.3 | — | — | 31.6 | 18.7 | 1 | 4.6 | 0.04 | .0013 | 0.8 | — |

TABLE I-C

COMPOSITIONS VARYING IN MOLAR RATIO OF TEA SOAP TO SODIUM SOAP

| Experiment | TEA | E-132 Fatty Acid | Glycerine | Ethanol | Added Water | Soap | T | Moist. | NaHSO3 | NaBH4 | Perfume | BHA |
|---|---|---|---|---|---|---|---|---|---|---|---|---|
| 26 | 39.0 | 0 | 8.3 | — | 12.3 | 40.3 | 1 | 12.0 | 0.05 | .0017 | — | — |
| 27 | 39.1 | 3.0 | 9.8 | — | 12.0 | 36.1 | 1 | 12.0 | 0.05 | .0015 | — | — |
| 28 | 40.9 | 6.2 | 8.1 | 2.6 | 13.3 | 28.5 | 1 | 11.8 | 0.20 | — | — | 0.2 |
| 29 | 44.2 | 9.4 | 8.3 | — | 14.3 | 23.7 | 1 | 12.0 | 0.05 | .0017 | — | — |
| 30 | 44.5 | 11.4 | 8.3 | — | 14.7 | 20.2 | 2 | 11.2 | 0.04 | .0013 | 0.8 | — |
| 31 | 45.6 | 12.0 | 8.3 | — | 14.8 | 19.2 | 1 | 12.0 | 0.05 | .0017 | — | — |
| 32 | 46.1 | 12.6 | 8.4 | — | 14.4 | 18.4 | 1 | 12.0 | 0.05 | .0017 | — | — |
| 33 | 46.1 | 13.0 | 8.3 | — | 15.2 | 17.3 | 1 | 12.0 | 0.05 | .0017 | — | — |
| 34 | 46.5 | 13.6 | 8.3 | — | 15.2 | 16.3 | 1 | 12.0 | 0.05 | .0017 | — | — |
| 35 | 47.8 | 14.4 | 8.2 | — | 15.2 | 14.3 | 1 | 12.0 | 0.05 | .0016 | — | — |
| 36 | 45.7 | 15.0 | 8.1 | 2.6 | 15.0 | 13.2 | 1 | 11.8 | 0.25 | — | — | 0.2 |
| 37 | 49.2 | 22.5 | 11.7 | — | 16.5 | — | 1 | 12.0 | 0.04 | .0012 | — | — |

TABLE I-D

COMPOSITIONS VARYING IN ALL THREE RATIOS WITHIN THE LIMITS IDENTIFIED ABOVE

| Experiment | TEA | E-132 Fatty Acid | E-625 Fatty Acid | Glycerine | Polyol | Propylene Glycol | Ethanol | Added Water | Soap | T | Moist. | NaHSO3 | NaBH4 | Perfume | BHA |
|---|---|---|---|---|---|---|---|---|---|---|---|---|---|---|---|
| 38 | 40.8 | 11.1 | — | 7.4 | — | — | — | 24.3 | 16.3 | 1 | 12.0 | 0.04 | .0015 | — | — |
| 39 | 41.1 | 10.5 | — | 7.6 | — | — | — | 22.7 | 17.2 | 1 | 4.6 | 0.04 | .0012 | 0.8 | — |
| 40 | 44.6 | 11.4 | — | — | — | 8.3 | — | 14.7 | 20.1 | 2 | 11.2 | 0.04 | .0013 | 0.8 | — |
| 41 | 45.8 | 11.8 | — | 8.5 | — | — | — | 15.0 | 18.9 | 3 | 4.5 | 0.04 | .0013 | — | — |
| 42 | 30.9 | 6.4 | — | 20.6 | — | — | 2.1 | 9.9 | 29.6 | 1 | 11.8 | 0.21 | — | — | 0.2 |
| 43 | 46.6 | 11.9 | — | 8.6 | — | — | — | 11.8 | 21.0 | 4 | 11.8 | 0.04 | .0013 | — | — |
| 44 | 44.7 | 11.5 | — | 8.3 | 7.4 | — | — | 7.4 | 20.2 | 1 | 11.8 | 0.20 | — | — | 0.2 |
| 45 | 44.6 | 11.4 | — | — | 8.3 | — | — | 14.6 | 20.2 | 1 | 11.8 | 0.04 | .0013 | 0.8 | — |
| 46 | 48.3 | 12.4 | — | 8.9 | — | — | — | 8.6 | 21.8 | 4 | 11.8 | 0.04 | .0014 | — | — |
| 47 | 48.7 | 12.5 | — | — | — | — | — | 16.1 | 21.9 | 2 | 11.2 | 0.04 | .0014 | 0.9 | — |
| 48 | 40.0 | 12.4 | — | 9.0 | — | — | — | 17.5 | 20.2 | 1 | 4.6 | 0.04 | .0014 | 0.9 | — |
| 49 | 43.1 | 12.9 | — | 7.8 | — | — | — | 15.0 | 21.1 | 1 | 4.6 | 0.04 | .0012 | — | — |
| 50 | 34.5 | 13.5 | — | 9.8 | — | — | — | 19.1 | 22.1 | 1 | 4.6 | 0.05 | .0015 | 1.0 | — |
| 51 | 42.6 | 14.2 | — | — | — | — | — | 18.1 | 25.1 | 1 | 11.8 | 0.03 | .0016 | — | — |
| 52 | 36.4 | — | 8.6 | 11.1 | — | — | 2.0 | 8.2 | 33.6 | 1 | 11.8 | — | — | — | — |
| 53 | 37.1 | — | 8.8 | 11.5 | — | — | — | 8.3 | 34.4 | 4 | 11.8 | — | — | — | — |
| 54 | 35.5 | — | 8.4 | 8.5 | — | — | 2.0 | 10.6 | 35.0 | 1 | 11.8 | — | — | — | — |
| 55 | 33.7 | 8.8 | — | 6.2 | — | — | 2.0 | 12.1 | 36.7 | 1 | 11.8 | 0.20 | — | — | 0.2 |
| 56 | 32.9 | 8.1 | — | 6.1 | — | — | 2.0 | 12.1 | 38.7 | 1 | 11.8 | — | — | — | — |
| 57 | 32.7 | 8.1 | — | 6.1 | — | — | 2.0 | 12.1 | 38.6 | 1 | 11.8 | 0.20 | — | — | 0.2 |
| 58 | 35.4 | — | 8.4 | 6.4 | — | — | 2.0 | 10.6 | 37.2 | 1 | 11.8 | — | — | — | — |
| 59 | 32.9 | — | 8.1 | 6.1 | — | — | 2.0 | 12.1 | 38.7 | 1 | 11.8 | — | — | — | — |
| 60 | 33.7 | 8.8 | — | — | 6.2 | — | 2.0 | 12.1 | 36.7 | 1 | 11.8 | 0.20 | — | — | 0.2 |

TABLE I-E

COMPOSITIONS VARYING IN ALL THREE RATIOS OUTSIDE THE LIMITS IDENTIFIED ABOVE

| Experiment | TEA | E-132 Fatty Acid | E-625 Fatty Acid | Glycerine | Polyol | Ethanol | Added Water | Soap | T | Moist. | NaHSO3 | NaBH4 | BHA |
|---|---|---|---|---|---|---|---|---|---|---|---|---|---|
| 61 | 47.7 | 11.6 | 3.5 | 12.3 | — | — | 12.9 | 12.0 | 4 | 7.5 | 0.04 | .0013 | — |
| 62 | 48.5 | 11.5 | 5.2 | 12.1 | — | — | 13.7 | 9.0 | 4 | 7.5 | 0.04 | .0013 | — |
| 63 | 52.3 | 11.5 | 10.4 | 12.1 | — | — | 13.7 | — | 1 | 12.0 | 0.04 | .0013 | — |
| 64 | 44.8 | 11.5 | — | 8.3 | 14.7 | — | 0 | 20.2 | 1 | 11.8 | 0.2 | — | 0.2 |
| 65 | 50.1 | 12.9 | — | 9.3 | — | — | 6.8 | 20.9 | 4 | 4.3 | 0.04 | .0014 | — |
| 66 | 7.5 | — | 10.0 | 27.5 | 27.5 | — | 17.5 | 10.0 | 1 | 11.8 | — | — | — |
| 67 | 32.6 | — | 8.4 | 6.4 | — | 2.0 | 10.6 | 40.0 | 1 | 11.8 | — | — | — |
| 68 | 33.1 | — | 13.8 | 10.0 | — | 2.9 | 7.0 | 33.3 | 4 | 11.8 | — | — | — |
| 69 | 33.1 | — | 13.8 | — | 10.0 | 2.9 | 7.0 | 33.3 | 4 | 11.8 | — | — | — |

Several items listed in Tables I-A through I-E require further explanation. Fatty acid E-132 represents a lily stearic acid which is a mixture containing 50% palmitic and 45% stearic acids, obtainable commercially from the Emery Chemical Co. under the trademark Emersol 132. Likewise, E-625 is a partially hardened coconut fatty acid having 49% lauric and 19% myristic acid available as Emery 625 from the Emery Chemical Co. Soap, in all the experiments, refers to opaque toilet soap, a mixture of sodium tallowate and sodium cocoate, where the ratio of tallowate to cocoate is specifically indicated by the term "T". Thus, the tallow:coconut ratio indicated by the numerals 1, 2, 3 and 4 are 82/18, 64/36, 40/60 and 0/100, respectively. Moisture refers to the % water in the opaque toilet soap. Polyol refers to a hydrogenated starch hydrosylate containing 70% solids and 30% water, obtainable commercially from the Imperial Chemical Industries of America under the trademark Polyol A-625. BHA is butylhydroxyanisole, an antioxidant.

EXAMPLE 2

This Example illustrates the improved performance obtainable by adherence to the aforedescribed critical ratios of soap to solvent, water to free triethanolamine, and triethanolammonium to sodium soaps.

TABLE II-A

VARIATIONS IN WEIGHT RATIO OF TOTAL SOAP TO SOLVENT

| Experiment | Weight Soap/ Solvent | Weight Water/ TEA | Molar TEA Soap/ Na Soap | Hardness | Clarity |
|---|---|---|---|---|---|
| 1 | 0.02 | 0.44 | 0.68 | 2 | 1 |
| 2 | 0.06 | 0.44 | 0.68 | 1 | 1 |
| 3 | 0.11 | 0.44 | 0.67 | 1 | 1 |
| 4 | 0.28 | 0.44 | 0.67 | 1 | 1 |
| 5 | 0.40 | 0.44 | 0.67 | 1 | 1 |
| 6 | 0.53 | 0.44 | 0.66 | 1 | 1 |
| 7 | 0.56 | 0.44 | 0.68 | 1 | 1 |
| 8 | 0.59 | 0.44 | 0.67 | 1 | 1 |
| 9 | 0.61 | 0.44 | 0.66 | 1 | 1 |
| 10 | 0.63 | 0.44 | 0.67 | 1 | 1 |
| 11 | 0.78 | 0.45 | 0.68 | 1 | 1 |
| 12 | 0.90 | 0.45 | 0.68 | 1 | 1 |
| 13 | 1.01 | 0.45 | 0.68 | 1 | 2 |

TABLE II-B

VARIATIONS IN WEIGHT RATIO OF WATER TO FREE TEA

| Experiment | Weight Soap/ Solvent | Weight Water/ TEA | Molar TEA Soap/ Na Soap | Hardness | Clarity |
|---|---|---|---|---|---|
| 14 | 0.56 | 0.06 | 0.68 | 1 | 3 |
| 15 | 0.56 | 0.25 | 0.68 | 1 | 2 |
| 16 | 0.59 | 0.36 | 0.68 | 1 | 1 |

TABLE II-B-continued

VARIATIONS IN WEIGHT RATIO OF WATER TO FREE TEA

| Experiment | Weight Soap/ Solvent | Weight Water/ TEA | Molar TEA Soap/ Na Soap | Hardness | Clarity |
|---|---|---|---|---|---|
| 17 | 0.55 | 0.44 | 0.67 | 1 | 1 |
| 18 | 0.55 | 0.44 | 0.67 | 1 | 1 |
| 19 | 0.55 | 0.44 | 0.67 | 1 | 1 |
| 20 | 0.52 | 0.55 | 0.67 | 1 | 1 |
| 21 | 0.55 | 0.55 | 0.67 | 1 | 1 |
| 22 | 0.55 | 0.66 | 0.67 | 1 | 1 |
| 23 | 0.55 | 0.81 | 0.67 | 1 | 1 |
| 24 | 0.55 | 1.00 | 0.67 | 1 | 2 |
| 25 | 0.55 | 1.42 | 0.67 | 1 | 2 |

TABLE II-C

VARIATIONS IN MOLAR RATIO OF TEA SOAP TO SODIUM SOAP

| Experiment | Weight Soap/ Solvent | Weight Water/ TEA | Molar TEA Soap/ Na Soap | Hardness | Clarity |
|---|---|---|---|---|---|
| 26 | 0.55 | 0.44 | 0.00 | 1 | 2 |
| 27 | 0.57 | 0.44 | 0.10 | 1 | 1 |
| 28 | 0.54 | 0.44 | 0.26 | 1 | 1 |
| 29 | 0.55 | 0.44 | 0.48 | 1 | 1 |
| 30 | 0.55 | 0.44 | 0.64 | 1 | 1 |
| 31 | 0.55 | 0.44 | 0.75 | 1 | 1 |
| 32 | 0.56 | 0.42 | 0.81 | 1 | 1 |
| 33 | 0.55 | 0.44 | 0.90 | 1 | 1 |
| 34 | 0.55 | 0.44 | 1.00 | 1 | 3 |
| 35 | 0.54 | 0.42 | 1.20 | 1 | 3 |
| 36 | 0.54 | 0.44 | 1.35 | 1 | 3 |
| 37 | 0.53 | 0.45 | ∞ | 2 | 3 |

TABLE II-D

VARIATIONS IN ALL THREE RATIOS WITHIN THE LIMITS IDENTIFIED ABOVE

| Experiment | Weight Soap/ Solvent | Weight Water/ TEA | Molar TEA Soap/ Na Soap | Hardness | Clarity |
|---|---|---|---|---|---|
| 38 | 0.46 | 0.76 | 0.81 | 1 | 1 |
| 39 | 0.49 | 0.66 | 0.67 | 1 | 1 |
| 40 | 0.55 | 0.44 | 0.64 | 1 | 1 |
| 41 | 0.57 | 0.40 | 0.61 | 1 | 1 |
| 42 | 0.57 | 0.49 | 0.26 | 1 | 1 |
| 43 | 0.59 | 0.36 | 0.54 | 1 | 1 |
| 44 | 0.61 | 0.31 | 0.68 | 1 | 1 |
| 45 | 0.61 | 0.51 | 0.67 | 1 | 1 |
| 46 | 0.62 | 0.27 | 0.54 | 1 | 1 |
| 47 | 0.63 | 0.44 | 0.64 | 1 | 1 |
| 48 | 0.63 | 0.55 | 0.67 | 1 | 1 |
| 49 | 0.67 | 0.44 | 0.68 | 1 | 1 |
| 50 | 0.72 | 0.74 | 0.67 | 1 | 1 |
| 51 | 0.79 | 0.61 | 0.67 | 1 | 1 |
| 52 | 0.80 | 0.40 | 0.40 | 1 | 1 |
| 53 | 0.83 | 0.40 | 0.32 | 1 | 1 |
| 54 | 0.83 | 0.50 | 0.38 | 1 | 1 |
| 55 | 0.86 | 0.57 | 0.29 | 1 | 1 |

TABLE II-D-continued

| VARIATIONS IN ALL THREE RATIOS WITHIN THE LIMITS IDENTIFIED ABOVE | | | | | |
|---|---|---|---|---|---|
| Experiment | Weight Soap/ Solvent | Weight Water/ TEA | Molar TEA Soap/ Na Soap | Hardness | Clarity |
| 56 | 0.88 | 0.59 | 0.25 | 1 | 1 |
| 57 | 0.88 | 0.59 | 0.25 | 1 | 1 |
| 58 | 0.90 | 0.51 | 0.35 | 1 | 1 |
| 59 | 0.93 | 0.62 | 0.33 | 1 | 1 |
| 60 | 0.94 | 0.63 | 0.29 | 1 | 1 |

TABLE II-E

| VARIATIONS IN ALL THREE RATIOS OUTSIDE THE LIMITS IDENTIFIED ABOVE | | | | | |
|---|---|---|---|---|---|
| Experiment | Weight Soap/ Solvent | Weight Water/ TEA | Molar TEA Soap/ Na Soap | Hardness | Clarity |
| 61 | 0.54 | 0.36 | 1.23 | 1 | 2 |
| 62 | 0.54 | 0.37 | 1.87 | 2 | 3 |
| 63 | 0.55 | 0.35 | ∞ | 2 | 3 |
| 64 | 0.67 | 0.18 | 0.68 | 1 | 2 |
| 65 | 0.63 | 0.21 | 0.58 | 1 | 2 |
| 66 | 0.48 | ∞ | 1.57 | 2 | 3 |
| 67 | 1.00 | 0.56 | 0.33 | 1 | 2 |
| 68 | 1.13 | 0.47 | 0.52 | 1 | 3 |
| 69 | 1.35 | 0.61 | 0.52 | 1 | 3 |

With regard to Tables II-A through II-E, hardness of the bar is designated either as "1" indicating firm or "2" indicating liquid. Only firm bars are acceptable within the context of this invention. Clarity is identified with a numeral 1, 2 or 3 indicating the resultant bar to be transparent, translucent or opaque, respectively. Only transparent bars are acceptable.

It should be noted that in the calculation of these ratios, the weight of soap refers to the total anhydrous weight of both triethanolammonium and sodium soaps. The weight of solvent refers to the total weight of free triethanolamine, water, and all water-miscible organic liquids. The weight of water refers to the total weight of water from all sources, including opaque toilet soap, Polyol, and added water.

Table II-A investigates the effect of varying the weight ratio of total fatty acid soap to solvent. The weight ratio of water to triethanolamine and molar ratio of triethanolamine soap to sodium soap were kept constant within this series of experiments. Experiment 1 demonstrates that when the weight of total soap to solvent was 0.02 the bar hardness was unacceptably liquid, although the clarity was transparent. Above 0.02 weight ratio up to 1.00, bars of acceptable hardness and transparency were obtainable. Experiment 13 delineates the outer limit of the weight ratio total soap to solvent as being below 1.01. At 1.01, the bar was no longer transparent but only translucent.

Table II-B investigates the variation in weight ratio of water to free triethanolamine. Here the weight ratio of total soap to solvent and molar ratio of TEA soap to sodium soap were kept constant. At 0.06 weight ratio water to free TEA as shown in experiment 14, hardness was acceptable but the bar was opaque. At 0.25 weight ratio water to free TEA as shown in experiment 15, hardness was acceptable but the bar was translucent. Experiments 16 through 23 illustrate weight ratios that provide acceptable hardness and clarity. Experiments 24 and 25 demonstrate that at 1.00 and 1.42 ratio, the bars become translucent.

Table II-C investigates the variation in molar ratio of TEA soap to sodium soap. For this series, the weight ratio of total soap to solvent and water to free TEA were kept constant. Experiment 26 indicates that there must be at least some TEA soap present; i.e. the molar ratio of TEA soap to sodium soap must be greater than zero to obtain transparency. Experiments 27 to 33 define the acceptable range of the aforementioned molar ratio. Firm and transparent bars were obtained in this region. Experiments 34 through 37 show that molar ratios of 1.00 or higher result in opaque bars, and at very high ratios cause the composition to be liquid.

Table II-D investigates random variations in all three ratios within the limits identified by Tables II-A through II-C. All compositions within this Table provide bars of both acceptable hardness and clarity.

Table II-E investigates variations in the three ratios which are outside the limits defined by Tables II-A through II-C. All compositions listed within this Table have either or both a hardness and clarity problem.

The foregoing description and Examples illustrate selected embodiments of the present invention. In light thereof, various modifications will be suggested to one skilled in the art all of which are within the spirit and purview of this invention.

What is claimed is:

1. A transparent bar comprising:

(i) a mixture of alkanolammonium and alkali metal $C_{12}$–$C_{22}$ atom fatty acid salts, the mole ratio of alkanolammonium to alkali metal fatty acid salt ranging from about 0.1 to less than 1.0;

(ii) a liquid solvent including an amount of water and free alkanolamine in a respective weight ratio ranging from greater than 0.25 to less than 1.0; and wherein the weight ratio of total fatty acid salt to solvent ranges from greater than 0.02 to less than 1.0.

2. A bar according to claim 1 wherein the alkanolamine is triethanolamine and the alkanolammonium ion is triethanolammonium.

3. A bar according to claim 1 wherein the ratio of alkanolammonium to alkali metal fatty acid salt ranges from 0.5 to 0.9.

4. A bar according to claim 1 wherein the ratio of alkanolammonium to alkali metal fatty acid salt ranges from 0.6 to 0.7.

5. A bar according to claim 1 wherein the ratio of total fatty acid salt to solvent ranges between 0.25 and 0.75.

6. A bar according to claim 1 wherein the ratio of total fatty acid salt to solvent ranges from 0.5 to 0.6.

7. A bar according to claim 1 wherein the ratio of water to free alkanolamine ranges from 0.35 to 0.6.

8. A bar according to claim 1 wherein the ratio of water to free alkanolamine ranges from 0.4 to 0.5.

9. A bar according to claim 1 wherein said fatty acid salts are a mixture of tallow and coconut fatty acid salts.

10. A bar according to claim 9 wherein the ratio of tallow to coconut ranges from 90:10 to 30:70.

11. A bar according to claim 1 further comprising a compound selected from the group consisting of the salts of bisulfite, hydrosulfite, metabisulfite, sulfite and mixtures thereof.

12. A bar according to claim 11 wherein the concentration of the compound ranges from 0.03 to 0.2 wt. %.

13. A bar according to claim 11 wherein the concentration of the compound ranges from 0.03 to 0.06 wt. %.

14. A bar according to claim 1 wherein the solvent further comprises a material selected from the group consisting of mono- and poly-hydric alcohols, alkyl and aryl ethers, alkyl and aryl esters, alkyl and aryl ketones, and mixtures thereof.

* * * * *